US008187024B2

(12) United States Patent
Williams et al.

(10) Patent No.: US 8,187,024 B2
(45) Date of Patent: May 29, 2012

(54) CONNECTOR ASSEMBLY WITH A LIGHT INDICATIVE OF A CONNECTOR STATUS

(75) Inventors: Brian James Williams, York, PA (US); William Edward Tanis, III, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 99 days.

(21) Appl. No.: 12/408,825

(22) Filed: Mar. 23, 2009

(65) Prior Publication Data

US 2010/0240246 A1 Sep. 23, 2010

(51) Int. Cl.
*H01R 3/00* (2006.01)

(52) U.S. Cl. ..... 439/488

(58) Field of Classification Search ..... 439/488, 439/894; 428/192, 162; 362/489, 26, 95, 362/800

See application file for complete search history.

(56) References Cited

U.S. PATENT DOCUMENTS

| | | | | |
|---|---|---|---|---|
| 5,039,832 | A | 8/1991 | Polacek et al. | |
| 5,383,799 | A * | 1/1995 | Fladung | 439/652 |
| 5,545,448 | A | 8/1996 | Ford et al. | |
| D391,182 | S | 2/1998 | Schneider et al. | |
| 5,780,775 | A * | 7/1998 | Yu | 174/135 |
| 5,969,306 | A | 10/1999 | Velauthapillai et al. | |
| 6,211,581 | B1 * | 4/2001 | Farrant | 307/117 |
| D446,141 | S | 8/2001 | Shafiyan-Rad et al. | |
| 6,588,924 | B1 * | 7/2003 | Friepes | 362/489 |
| 6,663,417 | B1 | 12/2003 | Hung | |
| 6,812,593 | B1 | 11/2004 | Fisher et al. | |
| 6,958,694 | B1 | 10/2005 | Shafiyan-Rad et al. | |
| 7,009,525 | B1 | 3/2006 | Shafiyan-Rad et al. | |
| 7,190,268 | B1 | 3/2007 | Rad et al. | |
| 2004/0150984 | A1 * | 8/2004 | Robertson et al. | 362/95 |
| 2007/0040698 | A1 | 2/2007 | Hoffmann et al. | |
| 2008/0264535 | A1 * | 10/2008 | Yu et al. | 150/165 |

FOREIGN PATENT DOCUMENTS

| | | |
|---|---|---|
| EP | 2 000 364 | 12/2008 |
| GB | 2 410 841 | 8/2005 |
| WO | WO 2009/026084 | 2/2009 |

OTHER PUBLICATIONS

International Search Report, International Application No. PCT/US2010/000832, International Filing Date, Mar. 23, 2009.

Phoenix Contact's Sensor/Actuator Boxes, Cables and Connectors, © 2004-2009 Control Design, PutnamMedia, 2 pgs.

Phoenix Contact Sensor/Actuator Cabling —PLUSCON field, © Phoenix Contact GmgH & Co. KG, Last modified Mar. 18, 2009, 3 pqs.

Phoenix Contact Simply connecting the sensor/actuator boxes to the control system, © Phoenix Contact GmgH & Co. KG, Last modified Mar. 18, 2009, 2 pgs.

TURK releases M12 eurofast junction box, , 2pgs.

* cited by examiner

*Primary Examiner* — Alexander Gilman

(57) ABSTRACT

A connector assembly includes a housing, a light source located within the housing, and a cover element covering at least a portion of a mating face of the housing. The housing includes a connector that is arranged to electrically mate with a peripheral connector proximate to the mating face of the housing. The light source generates light directed toward the mating face of the housing to indicate a status of the connector. The cover element includes a light transmissive area that is positioned to receive the light generated by the light source and transmit the light outward from the mating face in order to indicate the status of the connector.

22 Claims, 4 Drawing Sheets

CONNECTOR ASSEMBLY WITH A LIGHT INDICATIVE OF A CONNECTOR STATUS

BACKGROUND OF THE INVENTION

The subject matter herein relates generally to electrical connectors and, more specifically, to electrical connectors having lights that represent a status or state of an electrical connector.

Known junction and/or distribution boxes include electrical connectors. The junction boxes and/or distribution boxes mount several connectors in a housing. The connectors mate with peripheral devices to electrically couple the junction or distribution box with the peripheral device. The junction and/or distribution boxes include light sources located at or near the connectors. The light sources may be LEDs that project beyond an outer surface of the junction box and/or distribution box or that are located inside the box. The light sources correspond to the connectors. For example, each light source can be placed near one of the connectors. The light sources may emit light to indicate a status of the corresponding connector. For example, the light may indicate that a particular connector is receiving electrical power from a power source or that the connector is actively communicating data with a peripheral device.

Some known junction and/or distribution boxes include single points of light emanating from the light sources. For example, single LEDs may be mounted next to corresponding connectors. Alternatively, single LEDs mounted within the junction and/or distribution box may emit light into a light pipe that transmits the light to an outside surface of the box. The light emanates from the outside surface as a single point or from a relatively small area. In scenarios where multiple connectors in the junction and/or distribution box are mated with several peripheral connectors, the peripheral connectors and cables coupled to the peripheral connectors may partially block the light emanating from the box. For example, the relatively small areas from which the light emanates may be partially or fully obstructed from viewing by the peripheral connectors and/or the cables of the peripheral connectors. Blocking the lights can prevent operators of the junction and/or distribution box or the peripheral devices that are coupled to the box from seeing whether a particular light is emanating from the box. As a result, the operators may not be able to visually determine whether a particular connector in the junction or distribution box is in a powered state or currently is communicating data with a peripheral device.

As mentioned above, some of the known junction and/or distribution boxes include light pipes and other components within the housing of the box. The light pipes transmit light generated by a light source inside the housing to the outer surface of the housing. But, the inclusion of the light pipes may add to the complexity and cost of manufacturing the junction or distribution box.

BRIEF DESCRIPTION OF THE INVENTION

In one embodiment, a connector assembly is provided. The connector assembly includes a housing, a light source located within the housing, and a cover element covering at least a portion of a mating face of the housing. The housing includes a connector that is arranged to electrically mate with a peripheral connector proximate to the mating face of the housing. The light source generates light directed toward the mating face of the housing to indicate a status of the connector. The cover element includes a light transmissive area that is positioned to receive the light generated by the light source and transmit the light outward from the mating face in order to indicate the status of the connector.

In another embodiment, another connector assembly is provided. The connector assembly includes a housing, a light source in an interior chamber of the housing, and an insert molded film joined to a mating face of the housing. The housing includes a connector disposed at the mating face that is configured to mate with a peripheral connector. The light source projects light toward the mating face. The insert molded film includes a light transmissive area shaped to transmit light from the light source outward from the housing to represent a status of the connector. Optionally, the light generated by the light source directly propagates through the interior chamber from the light source to the insert molded film. A propagation path of the light may extend in a linear direction from the light source to the insert molded film and be devoid of physical obstructions to the light propagating from the light source to the insert molded film.

DETAILED DESCRIPTION OF THE INVENTION

Figure 1:
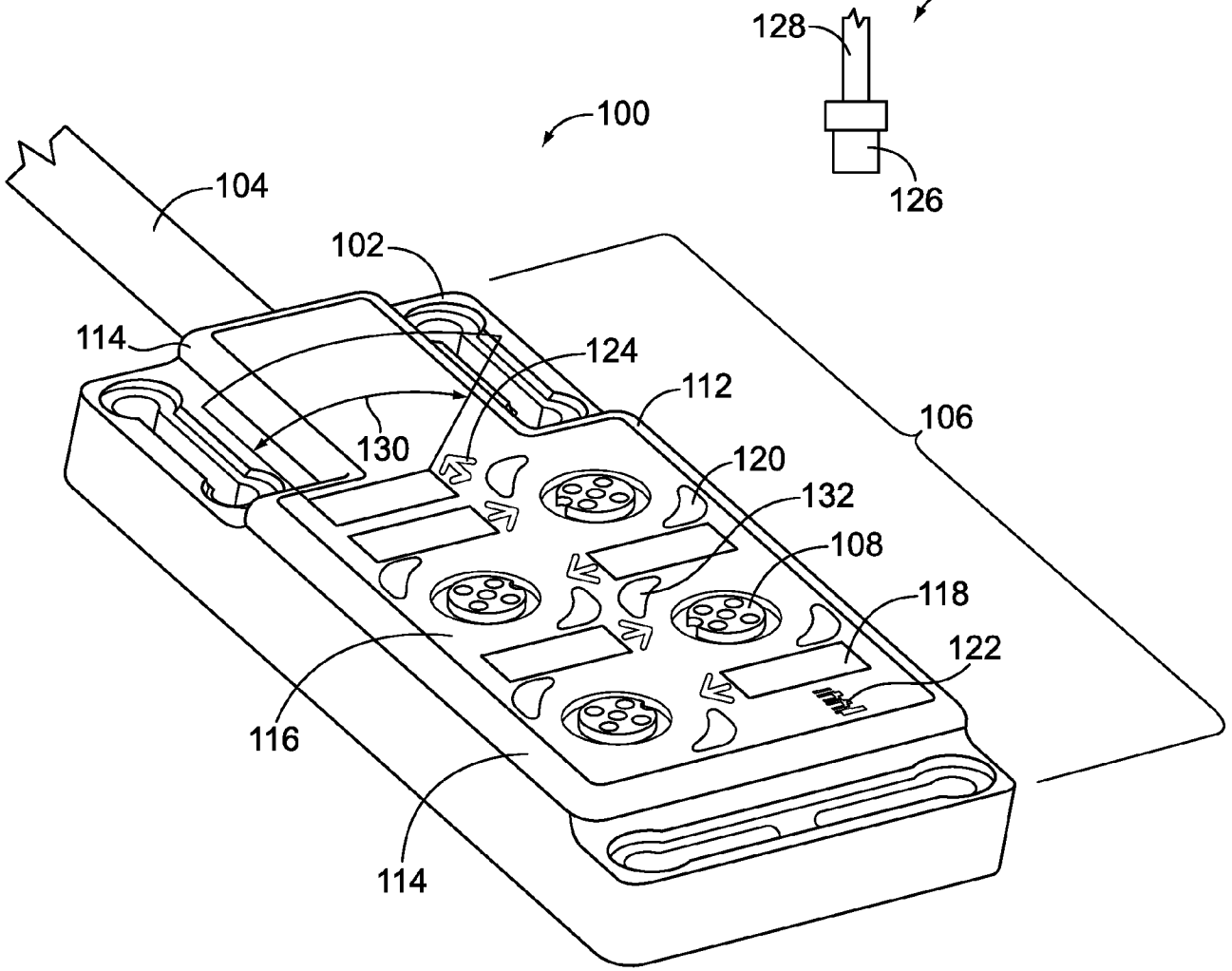
FIG. 1 is a perspective view of a connector assembly in accordance with one embodiment of the presently described invention.

FIG. 1 is a perspective view of a connector assembly 100 in accordance with one embodiment of the presently described invention. The connector assembly 100 includes a housing 102 coupled to a cable 104. The housing 102 includes several electrical connectors 108 disposed at or proximate to a mating face 106 of the housing 102. The connectors 108 are configured to mate with a peripheral connector 110 to electronically and mechanically couple the peripheral connector 110 with the connector 108. In the illustrated embodiment the peripheral connector 110 includes a cable 128 coupled to a plug end 126. The plug end 126 mates with the connector 108. The peripheral connector 110 may be electrically coupled to an external device (not shown). The connector assembly 100 shown in FIG. 1 is a distribution box or a junction box that houses several connectors 108 and couples the connectors 108 with the cable 104. The connector assembly 100 may comprise different connectors 108 or be used for one or more different purposes. The cable 104 is electrically joined with the connectors 108 to communicate one or more of power and data signals with the connectors 108.

The housing 102 may be formed from a dielectric material. For example, the housing 102 may be molded from one or more polymer materials or composites that include polymer materials. Alternatively, the housing 102 may include, or may be formed from, a conductive material, such as a metal. A cover element 112 is disposed at or proximate to the mating lace 106 of the housing 102. The cover element 112 may be provided as a substantially planar body. Alternatively, the cover element 112 may be provided as a substantially thin film that follows the contours and/or shape of the mating face 106. For example, as shown in FIG. 1, the cover element 112 may include rounded edges 114 that follow the rounded surface of the mating face 106. The cover element 112 may be formed as a insert molded film. For example, the cover element 112 may be formed of or include a dielectric material, such as a poly-carbonate PBT blend. In one embodiment, the cover element 112 is formed from, or includes, a polymer material that is chemically resistant and scratch resistant.

The cover element 112 includes an opaque field 116 and one or more light transmissive areas 120, 122, 132. As described below, light is generated within the housing 102 and is selectively transmitted outside of the housing 102 through one or more light transmissive areas 120, 122, 132 and blocked from transmitting outside of the housing 102 by the opaque field 116. The light transmissive areas 120, 122, 132 permit light to pass through the cover element 112 and emanate from the mating face 106 to represent a status of corresponding connectors 108. By way of example only, light may pass through a light transmissive area 120, 132 to indicate that the corresponding connector 108 is communicating a data signal with the peripheral connector 110. The connector 108 that corresponds to the light transmissive area 120, 132 may be determined by reference to other markings, such as arrows 124 on the cover element 112. The arrows 124 may be printed on the cover element 112 using the screening process described above. In another example, light may pass through the light transmissive areas 122 to indicate an electric power is being supplied to a corresponding connector 108. A label area 118 is included on the cover element 112 in the illustrated embodiment. The label area 118 may include an opaque area with text written thereon to provide information or labeling relevant to a corresponding connector 108. Alternatively, the label area 118 may be a light transmissive area similar to the light transmissive areas 120, 132. For example, the label area 118 may have informative text written thereon that is backlit by the light passing through the label area 118.

The opaque field 116 may be formed as a screen printed surface on the cover element 112. For example, the opaque field 116 may be an ink that is silk screened onto the cover element 112. The light transmissive areas 120, 122, 132 may be formed by the selective printing of the opaque field 116 onto the cover element 112. For example, the cover element 112 may be formed from a light transmissive material that permits light to propagate through the cover element 112 in areas where the opaque field 116 is not present. In the illustrated embodiment, a light transmissive area such as area 122 is formed by preventing the opaque field 116 from extending into the corresponding predetermined locations of the light transmissive areas 122. The light transmissive areas 120, 122, 132 may be colored to alter or adjust the color of the light that is transmitted through the corresponding light transmissive area 120, 122, 132. For example, the light transmissive area 120 may be printed with a light transmissive, colored ink that permits light to pass through and be altered by the light transmissive area 120.

The spatial arrangement, shape, and/or size of the light transmissive areas 120, 122, 132 may be adaptable to ensure that the light emanating from the light transmissive areas 120, 122, 132 is viewable from a relatively wide range 130 of viewing angles. A viewing angle represents the angle at which an operator views the light transmissive area 120, 122, 132. The viewable range 130 of viewing angles represents the span of viewing angles over which the light emanates from the corresponding label area 118 or light transmissive area 120, 122, 132. For example, the light transmissive areas 120, 122, 132 may be increased in size and/or shape such that the range 130 over which the light exists the housing 102 through the light transmissive areas 120, 122, 132 is increased. Increasing the range 130 of angles at which the light exits through the light transmissive areas 120, 122, 132 may ensure that the light is visible even when several peripheral connectors 110 are mated with the connectors 108. The cables 128 and plug ends 126 of the peripheral connectors 110 may block viewing of a substantial area of the cover element 112 when several peripheral connectors 110 are mated with the connectors 108. If the light transmissive areas 120, 122, 132 are not large enough, the peripheral connectors 110 may block an operator from seeing the light emanating from the light transmissive areas 120, 122, 132. The light transmissive areas 120, 122, 132 may therefore may be shaped and/or sized to be readily visible with peripheral connectors 110 obstructing viewing of the cover element 112 and the mating face 106 of the connector assembly 100.

Figure 2:
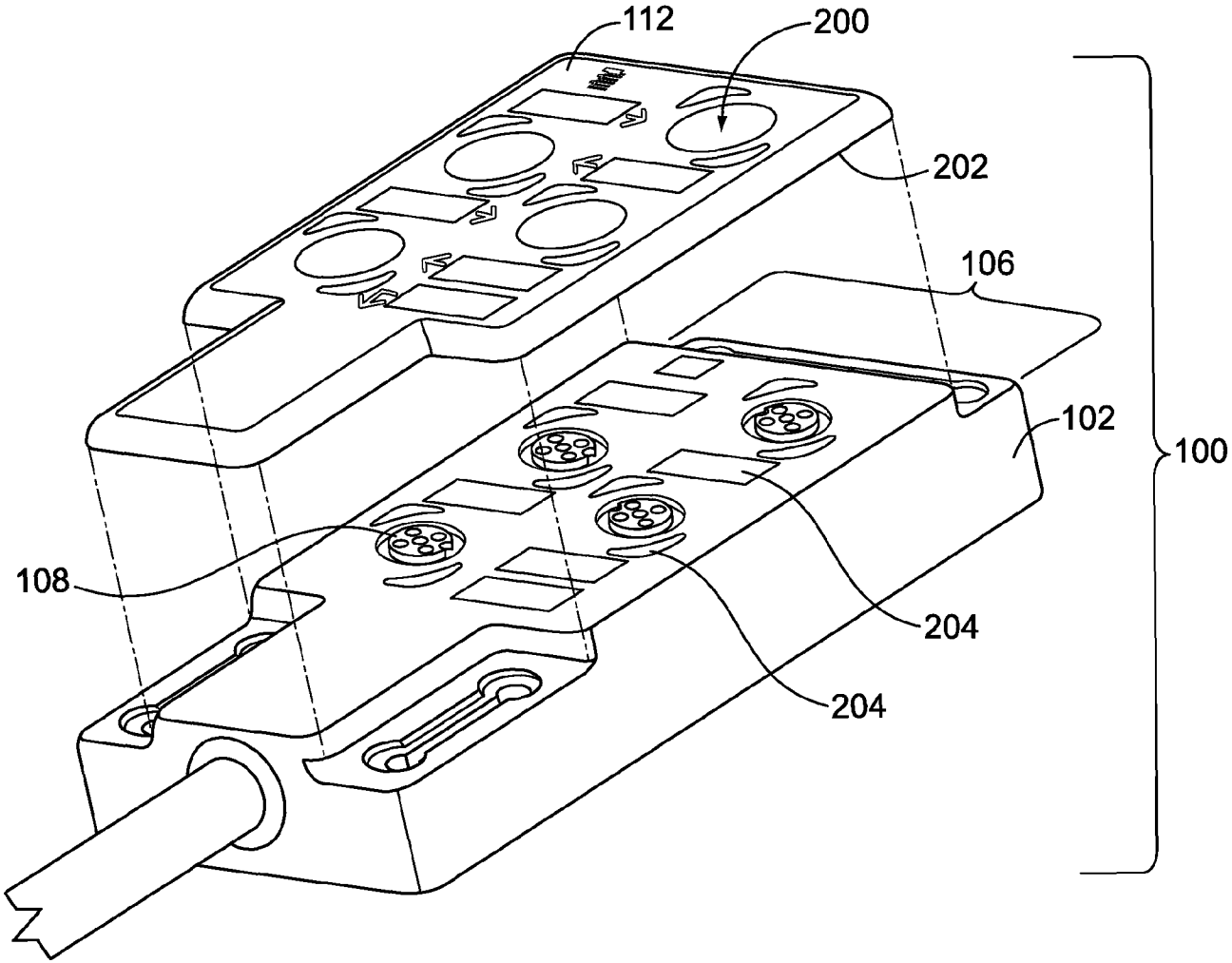
FIG. 2 is an exploded view of the connector assembly shown in FIG. 1 in accordance with one embodiment of the presently described invention.

FIG. 2 is an exploded view of the connector assembly 100 in accordance with one embodiment of the presently described invention. The cover element 112 includes connector openings 200 that are shaped and arranged in the cover element 112 to match up with the connectors 108 in the housing 102. For example, when the cover element 112 is placed on the mating face 106, the connectors 108 may be aligned with the connector openings 200 such that the peripheral connector 110 (shown in FIG. 1) may mate with the connectors 108 through the connector openings 200. Alternatively, the connectors 108 may protrude from the mating face 106 and through the connector openings 200 to permit mating with the peripheral connector 110.

An adhesive (not shown) may be placed on a bottom side 202 of the cover element 112. For example, the cover element 112 and the housing 102 may be separately formed, with an adhesive applied to the bottom side 202 before pressing the cover element 112 onto the mating face 106. The adhesive secures the cover element 112 to the mating face 106. Alternatively, the cover element 112 and the housing 102 may be molded to one another. For example, the housing 102 may be formed by molding the housing 102 onto the cover element 112. In another embodiment, the cover element 112 is formed by molding the cover element 112 onto the mating face 106 of the housing 102.

The housing 102 includes openings 204 extending through the mating face 106. These openings 204 may be shaped, sized and/or located on the mating face 106 to correspond to the light transmissive areas 120, 122 (shown in FIG. 1). For example, the openings 204 may have approximately the same shape and/or size as the corresponding light transmissive areas 120, 122. In one embodiment where the label areas 118 are light transmissive areas, openings 204 are positioned in the housing 102 to permit light to escape the housing 102 and propagate to the label areas 118. Alternatively, in an embodiment where the label areas 118 do not permit light to pass through the areas 118, the openings 204 are not provided at or near the label areas 118. The cover element 112 is placed on the mating face 106 such that the light transmissive areas 120, 122 are located over or proximate to the corresponding openings 204 and the housing 102. The cover element 112 may be secured to the mating face 106 around each of the openings 204 such that the cover element 112 seals the openings 204. For example, the cover element 112 may seal the openings 204 to prevent foreign objects such as dust, dirt, and the like, to enter into the housing 102 through the openings 204.

Figure 3:
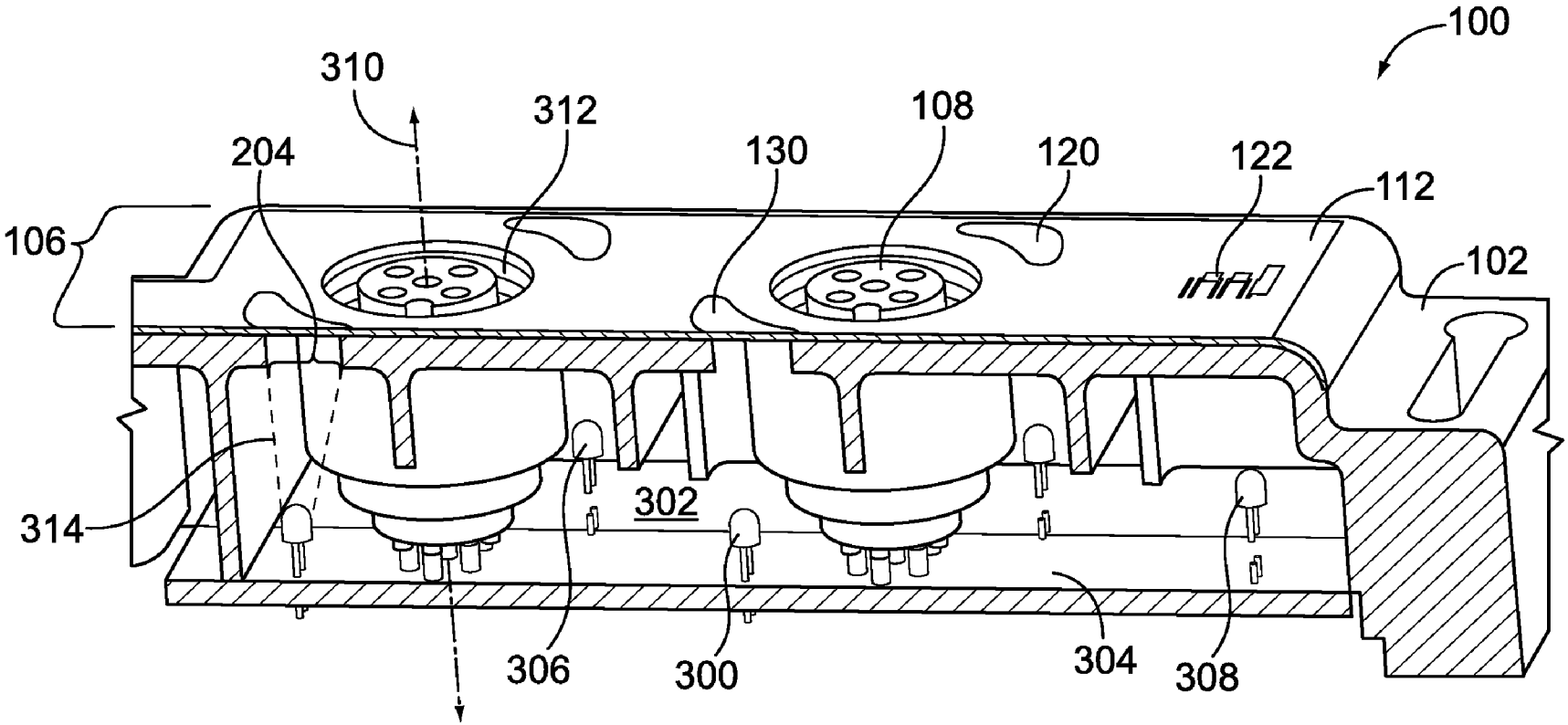
FIG. 3 is a partial cut-away view of the housing shown in FIG. 1 in accordance with one embodiment of the presently described invention.

FIG. 3 is a partial cut-away view of the housing 102 in accordance with one embodiment of the presently described invention. The housing 102 includes an interior chamber 302. A substrate 304 is disposed within the interior chamber 302 in the illustrated embodiment. The substrate 304 may include a printed circuit board, for example. The connectors 108 may be mounted to the substrate 304. For example, the connectors 108 may be elongated and oriented along a longitudinal axis 310. The connectors 108 extend from the substrate 304 and up through a connector channel 312 of the housing 102. The connector channel 312 is a via of the housing 102 that extends downward from the mating face 106 toward the substrate 304.

Several light sources 300, 306, 308 are mounted to the substrate 304 in the interior chamber 302. The connector 108 and light sources 300, 306, 308 may be electrically coupled to one more conductive pathways or traces (not shown) extending through the substrate 304. For example, the connector 108 may electrically join the substrate 304 and the peripheral connector 110 (shown in FIG. 1). Alternatively, the connectors 108 and/or the light sources 300, 306, 308 may be mounted to or joined with separate substrates 304 or other components within the housing 102.

The light sources 300, 306, 308 generate light upward from the substrate 304 and toward the cover element 112. In one embodiment, the light sources 300, 306, 308 are light emitting diodes (LED) that emit different colored lights. Alternatively, the light emitted by the light sources 300, 306, 308 may be the same color. While five light sources 300, 306, 308 are shown in FIG. 3, a different number of each of the light sources 300, 306, 308 may be provided.

The light sources 300, 306, 308 may be arranged within the interior chamber 302 such that the light generated by one light source 300, 306, 308 does not bleed into, or otherwise overlap with, the light emitted by a different light source 300, 306, 308. In the illustrated embodiment, each pair of the light sources 300, 306 associated with one of the connectors 108. The light sources 300, 306 in each pair are disposed on opposite sides of the connector 108 and separated from one another by approximately 180 degrees around the outer circumference or perimeter of the connector 108 within the interior chamber 302.

In the illustrated embodiment, the light sources 300, 306, 308 are positioned away from one another within the interior chamber 302 such that the light emitted by each light source 300, 306, 308 is emitted through a single one of the light transmissive areas 120, 122. For example, the light sources 300 may be positioned such that light emanating from the light sources 300 propagates through the interior chamber 302 and out of the housing 102 through a corresponding light transmissive area 132 without passing through a different light transmissive area 120, 122, 132. Similarly, the light sources 306 may be positioned such that light emanating from the light sources 306 propagates through the interior chamber 302 and out of the housing 102 through a corresponding light transmissive area 120 without passing through a different light transmissive area 120, 122, 132. The light sources 308 may be positioned such that light emanating from the light sources 308 propagates through the interior chamber 302 and out of the housing 102 through a corresponding light transmissive area 122 without passing through a different light transmissive area 120, 122, 132. Alternatively, two or more light sources 300, 306, 308 may be positioned close enough together such that the light emanating from the light sources 300, 306, 308 is at least partially mixed before passing through one of the light transmissive areas 120, 122, 132.

The light emanating from the light sources 300, 306, 308 propagates through the interior chamber 302 into the openings 204 of the housing 102. An example of one propagation path 314 for a single light source 300 is shown in FIG. 3. The description of the propagation of light from the light source 300 along the propagation path 314, through the opening 204 and the corresponding light transmissive area 132 also may apply to a different light source 300, 306, 308.

At least some of the light travels along a propagation path 314 to one of the openings 204. The propagation path 314 is schematically shown in FIG. 3 as a volume of space encompassed by the light that emanates from the light source 300 and passes through the light transmissive area 132. Alternatively, the propagation path 314 may have a different shape or volume. For example, the propagation path 314 may be altered by one or more reflective surfaces, refractive elements, and the like, provided along or adjacent to the propagation path 314. The propagation path 314 represents the volume of the interior chamber 302 that is encompassed by an approximately direct path of light travelling from the light source 300 to the opening 204. Some of the light may not travel along the propagation path 314 and may be contained within the interior chamber 302 or may exit the housing 102 through another light transmissive area 120, 122, 132. In the illustrated embodiment, the light generated by the light source 300 travels directly to the light transmissive area 132. For example, the light from the light source 300 directly propagates through the interior chamber 302 from the light source 300 to the cover element 112 without passing through any physical obstructions along the propagation path 314. The light may pass through interior chamber 302 without passing through any physical light transmissive body such as, for example, a light pipe (not shown).

As described above, the light transmissive areas 120, 122, 132 may be colored with a light transmissive ink or material that adjusts or alters the color of the light as the light passes through the light transmissive area 120, 122, 132. The light transmissive areas 120, 122, 132 may diffuse the light as the light passes through the light transmissive areas 120, 122, 132. For example, the cover element 112 may be formed from a material that diffuses the light. The light may be diffused in order to mix light generated by two or more light sources 300 and/or 306 or to create a more even distribution of light intensity emanating from the light transmissive area 120, 122, 132.

Figure 4:
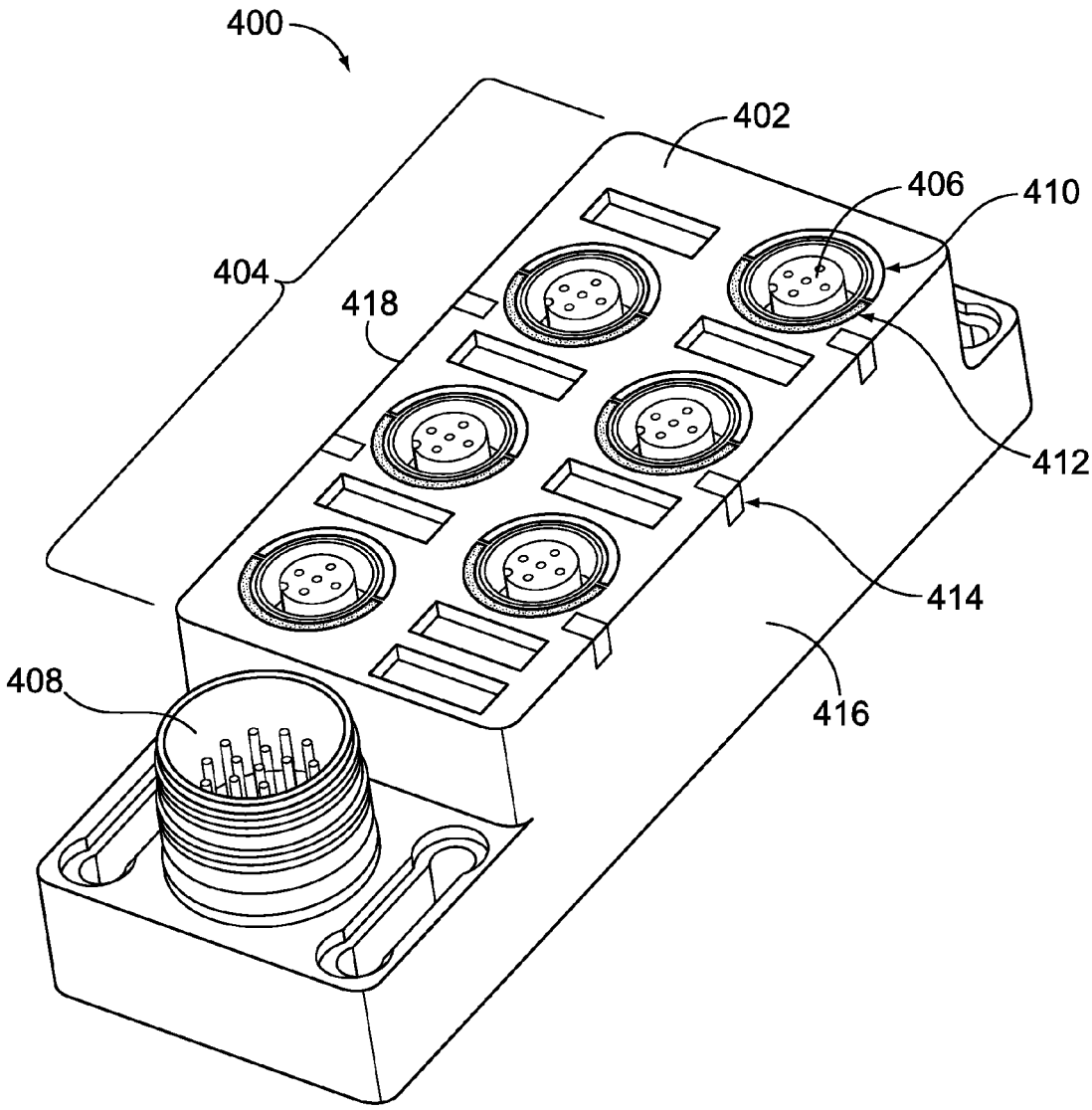
FIG. 4 is a perspective view of a connector assembly in accordance with another embodiment of the presently described invention.

FIG. 4 is a perspective view of a connector assembly 400 in accordance with another embodiment of the presently described invention. Similar to the connector assembly 100 shown in FIG. 1, the connector assembly 400 includes a housing 402 having a mating face 404. Several connectors 406, 408 are disposed at or proximate to the mating face 404. The connectors 406, 408 mate with peripheral connectors (not shown) similar to the peripheral connector 110 (shown in FIG. 1).

The connector assembly 400 includes light transmissive areas 410, 412, 414. Similar to the light transmissive areas 120, 122 (shown in FIG. 1), the light transmissive areas 410, 412, 414 permit light generated inside the housing 402 to be transmitted out of the housing 402 through the mating face 404. The connector assembly 400 includes an interior chamber (not shown) similar to the interior chamber 302 (shown in FIG. 3) and may include one or more light sources 300, 306 (shown in FIG. 3) in the interior chamber. The light sources (not shown) emit or generate light that is representative of a state or condition of a corresponding connector 408, similar to as described above in connection with the connector assembly 100.

One difference between the connector assembly 400 and the connector assembly 100 (shown in FIG. 1) is that the connector assembly 400 does not include the cover element 112 (shown in FIG. 1). Instead, the light transmissive areas 410, 412, 414 are provided in the mating face 404 as light transmissive bodies or portions of the mating face 404. For example, the light transmissive areas 410, 412, 414 may be lenses located at the mating face 404. The lenses refract the light to alter a distribution or direction in which the light emanates from the light transmissive areas 410, 412, 414. Alternatively, the light transmissive areas 410, 412, 414 may be bodies that are inserted into corresponding openings (not shown) in the mating face 404. The bodies permit the light to pass through the light transmissive areas 410, 412, 414 without significantly altering the distribution or direction in which the light emanates from the light transmissive areas 410, 412, 414. The light transmissive areas 410, 412, 414 may include a translucent plastic or polymer material that is tinted with a color. The light generated within the housing 402 propagates to the light transmissive areas 410, 412, 414 and the color of the light is adjusted or altered by the tinted light transmissive areas 410, 412, 414 prior to emanating from the mating face 404. The color of the light that emanates from each of the light transmissive areas 410, 412, 414 may be established to correspond to a status of a corresponding connector 406. For example, a green light emanating from the light transmissive areas 414 may represent a powered state or status of the corresponding connectors 406. A yellow light emanating from the light transmissive areas 410 may represent a communication state of the corresponding connectors 406, where a data signal is being communicated between the corresponding connector 406 and a peripheral connector.

The light transmissive areas 410, 412, 414 may be provided in different shapes and/or sizes to increase the viewing angles in which the light emanating from the light transmissive areas 410, 412, 414 is viewable. In the illustrated embodiment, the light transmissive areas 410, 412 extend around at least a portion of the circumference of the connectors 408. Extending the light transmissive areas 410, 412 around at least a portion of the circumference of the connectors 408 may increase the viewability of the light transmissive areas 410, 412. For example, the light emanating through the light transmissive areas 410, 412 to be viewable from wide range of viewing angles even when a peripheral connector (not shown) is loaded into the connector 408.

The light transmissive areas 414 may be shaped to provide an increased viewing angle of light emanating from light transmissive area 414. As shown in FIG. 4, the light transmissive areas 414 extend across a portion of the mating face 404 and onto a portion of a side 416 or a side 418 of the housing 402. The sides 416, 418 are transverse to the mating face 404. For example, the sides 416, 418 may be approximately parallel to one another and approximately perpendicular to the mating face 404. The light transmissive area 414 may extend along at least two of the mating face 404 and the sides 416, 418 to increase the angles over which the light emanating from the light transmissive areas 414 is viewable. For example, light emanating from the light transmissive areas 414 may be viewable above the mating face 404 and to the side of the housing 402.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third." etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing having a mating face with a connector channel and a light transmission opening extending through the housing, the housing including an interior chamber and a connector arranged to electrically mate with a peripheral connector;

a light source located proximate to the housing, the light source configured to generate light directed toward the light transmission opening in the mating face of the housing to indicate a status of the connector; and a cover element coupled with the housing such that the cover element extends over the light transmission opening in the mating face of the housing, the cover element having a connector opening aligned with the connector channel such that the peripheral connector mates with the connector of the housing through the connector opening and the connector channel, the cover element including a light transmissive area formed from the cover element and positioned to receive the light passing through the light transmission opening from the light source and transmit the light outward from the mating face in order to indicate the status of the connector, wherein the light transmissive area at least partially encircles the connector opening at the mating face of the housing.

2. The connector assembly of claim 1, wherein the cover element seals the light transmission opening of the housing.

3. The connector assembly of claim 1, wherein the housing is molded to the cover element.

4. The connector assembly of claim 1, wherein the status of the connector indicates at lest one of a powered state of the connector assembly.

5. The connector assembly of claim 1, wherein the light directly propagates through an interior chamber of the housing from the light source to the cover element through the light transmission opening of the housing.

6. The connector assembly of claim 1, wherein a propagation path of the light extends in a linear direction from the light source to the cover element through the light transmission opening of the housing, the propagation path being devoid of physical obstructions to the light propagating from the light source to the cover element.

7. The connector assembly of claim 1, wherein the cover element comprises a screen printed opaque area to prevent a portion of the light from passing through the cover element.

8. The connector assembly of claim 1, wherein the light transmissive area extends around at least a portion of a circumference of the connector.

9. The connector assembly of claim 1, wherein the light transmissive area is a translucent area configured to diffuse the light out of the cover element.

10. The connector assembly of claim 1, wherein the status of the connector indicates transmission of a signal between the connector and the peripheral connector.

11. The connector assembly of claim 1, wherein the mating face of the housing is an approximately planar surface with both the light transmissive opening and the connector channel of the housing extending through the same planar surface of the mating face.

12. A connector assembly comprising:

a housing including a mating face having a light transmission opening and a connector channel extending through the housing, the housing defining an interior chamber accessible through the light transmission opening and the connector channel, the connector including a connector configured to mate with a peripheral connector;

a light source provided in the interior chamber to project light toward the light transmission opening in the mating face of the housing; and an insert molded film joined to the mating face of the housing, the insert molded film comprising a connector opening and a light transmissive area, the connector opening aligned with the connector channel to permit the peripheral connector to mate with the connector of the housing through the connector opening, the light transmissive area formed from the insert molded film and aligned with the light transmission opening to permit light from the light source to transmit outward from the housing to represent a status of the connector, wherein the light transmissive area at least partially encircles the connector opening at the mating face of the housing.

13. The connector assembly of claim 12, wherein the insert molded film seals the light transmission opening of the housing.

14. The connector assembly of claim 12, wherein the housing is molded to the insert molded film.

15. The connector assembly of claim 12, wherein the status of the connector indicates a powered state of the connector assembly.

16. The connector assembly of claim 12, wherein the light directly propagates through the interior chamber from the light source to the insert molded film through the light transmission opening of the housing.

17. The connector assembly of claim 12, wherein a propagation path of the light extends in a linear direction from the light source to the insert molded film through the light transmission opening of the housing, the propagation path being devoid of physical obstructions to the light propagating from the light source to the insert molded film.

18. The connector assembly of claim 12, wherein the insert molded film comprises a screen printed opaque area to prevent a portion of the light from passing through the insert molded film.

19. The connector assembly of claim 12, wherein the light transmissive area extends around at least a portion of a circumference of the connector opening in the housing.

20. The connector assembly of claim 12, wherein the insert molded film comprises a plurality of the light transmissive areas each representative of a different status of the connector.

21. The connector assembly of claim 12, wherein the mating face of the housing is an approximately planar surface with the light transmission opening and the connector channel of the housing extending through the same planar surface of the mating face.

22. The connector assembly of claim 12, wherein the status of the connector indicates transmission of a signal between the connector and the peripheral connector.

* * * * *